US008641365B2

(12) United States Patent
Ahaus et al.

(10) Patent No.: US 8,641,365 B2
(45) Date of Patent: Feb. 4, 2014

(54) ROTOR OF A GAS TURBINE

(75) Inventors: Guido Ahaus, Essen (DE); Francois Benkler, Ratingen (DE); Ulrich Ehehalt, Essen (DE); Harald Hoell, Wächtersbach (DE); Karsten Kolk, Mülheim a.d. Ruhr (DE); Walter Loch, Mülheim an der Ruhr (DE); Harald Nimptsch, Essen (DE); Oliver Schneider, Wesel (DE); Peter-Andreas Schneider, Münster (DE); Peter Schröder, Essen (DE); Vyacheslav Veitsman, Gelsenkirchen (DE)

(73) Assignee: Siemens Aktiengesellschaft, Munich (DE)

( * ) Notice: Subject to any disclaimer, the term of this patent is extended or adjusted under 35 U.S.C. 154(b) by 1030 days.

(21) Appl. No.: 12/530,501

(22) PCT Filed: Feb. 15, 2008

(86) PCT No.: PCT/EP2008/051872

§ 371 (c)(1),
(2), (4) Date: Feb. 11, 2010

(87) PCT Pub. No.: WO2008/110429

PCT Pub. Date: Sep. 18, 2008

(65) Prior Publication Data

US 2010/0166559 A1 Jul. 1, 2010

(30) Foreign Application Priority Data

Mar. 12, 2007 (EP) ..... 07005079

(51) Int. Cl.
*F01D 5/06* (2006.01)

(52) U.S. Cl.
USPC ..... 415/111; 415/229; 416/174; 416/244 A

(58) Field of Classification Search
USPC ..... 415/111, 115, 116, 117, 229, 230, 231, 415/261.1; 416/96 R, 500, 174, 244 A
See application file for complete search history.

(56) References Cited

U.S. PATENT DOCUMENTS 2,023,192 A * 12/1935 Bart ..... 205/73
2,579,745 A 12/1951 Lombard et al.

(Continued)

FOREIGN PATENT DOCUMENTS

CH 259566 A 1/1949
CH 344737 A 2/1960

(Continued)

OTHER PUBLICATIONS

English Translation of JP 10266802 (A), Shibukawa Naoki, Gas turbine rotor, Oct. 6, 1998.*

(Continued)

*Primary Examiner* — Edward Look
*Assistant Examiner* — Maxime Adjagbe

(57) ABSTRACT

A rotor of a thermal turbomachine, particularly a gas turbine, is provided. The rotor includes a plurality of individual rotor components that are held together by a tie-bold and combined into a unit. The tie-bolt is supported by the assembly of the surrounding rotor components including the tie-bolt and the rotor disks. A hollow shaft which is made up of two tubular sections and a support wheel further support the rotor.

16 Claims, 4 Drawing Sheets

(56) References Cited

U.S. PATENT DOCUMENTS

| | | | | |
|---|---|---|---|---|
| 2,621,018 | A | 12/1952 | Barrett | |
| 2,798,383 | A | 7/1957 | Van Cleave | |
| 3,038,556 | A | 6/1962 | Hamm et al. | |
| 3,680,979 | A * | 8/1972 | Hansen et al. | 416/198 R |
| 3,749,516 | A | 7/1973 | Samurin et al. | |
| 4,247,256 | A | 1/1981 | Maghon | |
| 6,406,263 | B1 | 6/2002 | Meacham et al. | |
| 6,481,917 | B1 | 11/2002 | Chen et al. | |
| 2003/0017878 | A1 | 1/2003 | Muju et al. | |
| 2008/0159864 | A1 * | 7/2008 | Hoell | 416/179 |

FOREIGN PATENT DOCUMENTS

| | | | |
|---|---|---|---|
| DE | 2034088 | A1 | 1/1972 |
| DE | 2643886 | B1 | 6/1977 |
| EP | 1577493 | A1 | 9/2005 |
| GB | 703489 | A | 2/1954 |
| GB | 749279 | A | 5/1956 |
| JP | 50036683 | A | 4/1975 |
| JP | 58070096 | A | 4/1983 |
| JP | 10266802 | A * | 10/1998 |
| JP | 2000161002 | A | 6/2000 |
| NL | 50163 | C | 4/1941 |
| RU | 2230195 | C2 | 6/2004 |
| WO | WO2005093219 | * | 10/2005 |
| WO | WO 2007051443 | A1 | 5/2007 |

OTHER PUBLICATIONS

Machine translation of WO2005093219 A1—Hoell harald, Oct. 2005.*

Communication from the Japanese Patent Office, Feb. 14, 2012, pp. 1-5.

* cited by examiner

ROTOR OF A GAS TURBINE

CROSS REFERENCE TO RELATED APPLICATIONS

This application is the US National Stage of International Application No. PCT/EP2008/051872, filed Feb. 15, 2008 and claims the benefit thereof. The International Application claims the benefits of European Patent Office application No. 07005079.4 EP filed Mar. 12, 2007, both of the applications are incorporated by reference herein in their entirety.

FIELD OF INVENTION

The invention refers to a rotor according to the claims. The invention furthermore refers to a thermal turbomachine with such a rotor.

BACKGROUND OF INVENTION

Steam turbines and gas turbines, and also rotary compressors, are counted among thermal turbomachines. These customarily have a rotatably mounted rotor which is enclosed by a stationary housing. The stationary sub-assemblies of a thermal turbomachine are collectively also referred to as a stator. A flow passage for a compressible flow medium, which extends in the axial direction of the turbomachine, is arranged between the rotor and the stator. Rotor blades which are assembled together to form blade groups or blade rows and which project into the flow passage, are customarily fastened on the rotor. In the case of a prime mover, such as a gas turbine, the rotor blades serve for driving the rotor shaft by means of impulse transfer from a hot, pressurized flow medium. The thermal energy of the flow medium, therefore, during its expansion, is converted into mechanical energy which can be used for example for driving an electric generator.

In the case of a rotary compressor which is counted among driven machines, the rotor shaft on the other hand is driven for example by means of an electric motor or internal combustion engine or in another way. The rotor blades which are arranged on the rotor side serve in this case for compressing the flow medium which is in the flow passage and at the same time is heated during this process. That is to say mechanical energy is converted into thermal energy of the flow medium.

The rotating component of a gas turbine, which is also referred to as a rotor, as a rule is subjected to a high mechanical and thermal stress. In particular, the rotor components which form the rotor are heavily stressed as a result of the high temperature of the operating medium and as a result of the forces which act upon the rotor during operation of the gas turbine. In order to nevertheless be able to ensure the operational safety on the one hand and to keep the production costs of the rotor within acceptable limits on the other hand, a number of constructional possibilities were proposed in the past.

A proposed embodiment of the rotor can be realized for example by means of its production from one part. Such a production method, however, is comparatively costly in the manufacturing process. In particular, no prefabrication which is independent of order and no parallel machining of individual parts either is possible so that high production processing times result. Moreover, a larger axial distance between the adjacent rotor blade rings has to be accepted in order to be able to produce with corresponding tools the contours which are required for the fastening of the blades. These manufacturing-dependent, relatively large distances between the rotor blade rings, however, impair the rotor dynamics.

It is furthermore known for example from DE 26 43 886 B1 to also assemble the gas turbine rotor from individual rotor components, wherein the individual rotor components are held together via a tie-bolt. This type of rotor construction can also be used for steam turbines according to CH 344 737. Each rotor component, which is formed as a rotor disk, has an axially extending recess through which the tensioned tie-bolt can extent. By means of threaded nuts which are screwed onto the tie-bolt at the end, this can be tensioned, as a result of which the rotor components, which abut against each other by their end faces, can be clamped to each other. The rotor components are then pressed against each other by the tie-bolt and transmit the rotational forces which act upon them via a so-called Hirth toothing which, disposed on the end face in each case, forms a form-fit between two abutting rotor components.

The rotor of the gas turbine is arranged in the housing of the turbine by means of suitable bearings at the ends. Instead of the threaded nuts, on the casing side more complexly designed components can also be screwed onto the end of the tie-bolt, which in addition to clamping the rotor components also enable further functions, such as the supporting of the rotor in a radial bearing and/or thrust bearing.

During operation of the gas turbine, however, vibrations occur in the rotor, the frequency of which inter alia is dependent upon the spacing of the two thrust bearings, i.e. upon the freely vibrating length of the rotor and especially upon the freely vibrating length of the tie-bolt, in the case of such a type of construction. With increasing overall length of the gas turbine, the freely vibrating length of the tie-bolt also increases, which leads to its natural frequency being shifted to a lower level close to the rotational frequency of the rotor components. This frequency shift can lead to impermissibly high vibration amplitudes during operation of the gas turbine, which can impair the function of the rotor and can lead to damage of the turbine.

In order to counteract this problem, DE 26 43 886 B1 proposes cup rings. The cup rings create an axial connection between rotor disks and tie-bolt in order to reduce its vibrations. The cup rings, however, are not able to be used in the region of a hollow shaft.

Alternatively to this, from NL 50 163 C it is known to seat all the rotor disks of a rotor on a tie-bolt. This type of construction, however, is not installation-friendly. As a specialization of this variant, DE 20 34 088 discloses shells which for maintaining an elastic contact between rotor disks and tie-rod encompass the last-named. Also, this embodiment is comparatively costly during installation.

SUMMARY OF INVENTION

It is generally desirable to keep the natural frequency of the tie-bolt sufficiently above the operating speed, even in the case of increasing overall length of the turbine. Therefore, on the one hand the operational safety of the turbine would be ensured, and on the other hand the increasing power requirement, for the coverage of which for example an extension of the overall length of the gas turbine is necessary, could consequently be met.

The invention is therefore based on the object of disclosing a rotor of the type referred to in the introduction, which ensures a safe operation of the gas turbine even in the case of increasing overall length. Furthermore, the vibration amplitudes of the tie-bolt are to be kept as low as possible especially in the region of the hollow shaft.

This object is achieved according to the invention by the tie-bolt being supported in its center section. In this case, the support wheel which is arranged between turbine-side section and compressor-side section represents a rotor component which supports the tie-bolt.

The invention in this case starts from the consideration that for a reduction of vibration of the tie-bolt this should be supported on one of the rotor components, wherein the thermally induced different expansions of the rotor components therefore should be kept compensatable. In particular, the fact should be taken into account that owing to increasing requirements with respect to the output of the turbine its length increases, as a result of which the natural frequency of the tie-bolt approximates to the operating speed of the gas turbine. The reduction of the tie-bolt vibrations is achieved by the tie-bolt being supported by means of the support wheel. In this case, the support wheel represents a further supporting rotor component, wherein the support wheel in this case is connected to the tie-bolt, preferably, as seen in the axial direction of the rotor, in a region in which the amplitudes of the vibrations which occur during operation of the turbine reach their maximum values.

In order to keep the natural frequency of the tie-bolt sufficiently above the rotational frequency, a rigidity of the rotor component which is as high as possible is necessary. For this purpose, the support wheel is arranged between turbine-side section of the rotor and compressor-side section of the rotor, i.e. at the place of maximum deflection of the tie-bolt during possibly occurring tie-bolt vibrations. In the case of a gas turbine, this region lies for example between the compressor section and the turbine section. As a result, supporting of the tie-bolt at a particularly effective position from a vibration point of view is enabled.

Support of the tie-bolt is preferably consequently achieved by the support wheel being connected to the tie-bolt in a frictionally-locking and/or form-fitting manner.

For example, the support wheel can be shrunk on the tie-bolt. This type of connection is particularly suitable since in a simple manner a particularly rigid connection is therefore enabled between the support wheel and the tie-bolt. The thermally induced different expansions of the rotor components which occur during operation of the gas turbine, especially between the support wheel and the tie-bolt, can advantageously be compensated by preferably at least one of the rotor components being provided with a profile.

For example, by means of a profiled shaping of the hub of the support wheel the connection between the tie-bolt and the support wheel can be elastically adjusted in such a way that the differential volume on account of the different heating of the rotor components is largely compensated. For this purpose, the hub of the support wheel is preferably provided with a crowned profile as seen in the longitudinal direction of the rotor. With such a designed form of the hub which is flexible on the connection side, stresses and cracks in the rotor components can be prevented. The crowned profile of the support wheel hub can also be described in another way: the surface of the tie-bolt bore of the support wheel which lies opposite the cylindrical generated surface of the tie-bolt is curved as seen in the axial direction, wherein the curvature is directed towards the generated surface.

In a further expedient development, the support wheel is connected to two adjacently arranged rotor components by means of a Hirth toothing. By using such an axially effective connection the torque which acts upon the rotor can be transferred and redirected via the support wheel. Moreover, by means of the Hirth toothing a radial guideway for accommodating different heat and centrifugal force deformations is ensured. In particular, the occurrence of vibrations during operation of the gas turbine on account of a thermally induced uneven expansion of the support wheel can therefore be reduced.

In an especially advantageous development, the support wheel is provided with cooling recesses, wherein these are preferably uniformly arranged around the hub. Therefore, on account of the recesses which are introduced into the support wheel for cooling, a rib structure is advantageously framed which enables throughflow of a cooling medium in the axial direction of the rotor. Furthermore, on the one hand the surface of the support wheel can be enlarged as a result of the openings which are introduced and by means of cooling openings which are formed in such a way a problem-free transporting of the cooling air inside the rotor can be enabled.

In order to ensure a throughflow of the cooling medium, especially cooling air, in the axial direction of the rotor, between the tie-bolt and rotor components the recesses which serve as cooling openings are advantageously introduced in the support wheel, beginning close to the hub. In this way, cooling of the support wheel and also cooling air feed for the subsequently arranged rotor components as seen in the flow direction of the cooling medium is enabled. The tie-bolt can be encompassed by a number of concentrically arranged cooling separation pipes for suitable guiding of cooling medium, wherein these divide the passage which is formed between the tie-bolt and the rotor components which encompass the tie-bolt into a number of radially adjacent cooling passage sections. Consequently, the effect is achieved of the cooling of the rotor components being able to be carried out, especially in accordance with the cooling requirement of the respective turbine stage. That is to say, by means of cooling air openings which are formed in such a way a problem-free transporting of the cooling air inside the rotor is enabled. The cooling air separation pipes in this case are axially split into two sections for accommodating the support wheel in such a way that their ends which point in the direction of the support wheel can be guided in locating slots which are introduced in the support wheel as provision for the said ends.

The cooling air separation pipes, therefore, for one thing realize an improved heat dissipation, and for another thing the heat capacity of this rotor component can be reduced.

In the case of rotors which are referred to in the introduction, a so-called center hollow shaft is customarily arranged between the compressor-side section of the rotor and the turbine-side section of the rotor, which in the case of installing a support wheel according to the invention is axially divided into at least two tubular sections. The tubular sections are preferably essentially of equal length.

The advantages which are achieved with the invention are especially that as a result of the support wheel which is connected to the tie-bolt an especially safe operation of the gas turbine, even with its increasing overall length, is enabled. In particular, as a result of the suitable support of the tie-bolt its vibration amplitudes can be kept particularly low. Moreover, via this system a purposeful increase of the natural frequency of the tie-bolt with comparatively only little cost can be realized. Furthermore, the thermally induced relative movements between the tie-bolt and the rotor component which is formed as a support wheel can be compensated particularly well. At the same time, however, cooling, which is necessary on account of the high thermal stress of the rotor component, by means of a cooling air guideway which extends in the axial direction of the rotor is also ensured, even during the guiding through of cooling air at different pressures and temperatures which can be separately guided through separation pipes.

BRIEF DESCRIPTION OF THE DRAWINGS

An exemplary embodiment of the invention is explained in more detail with reference to a drawing. In this case, in the drawing.

Like components are provided with the same designations in all the figures.

DETAILED DESCRIPTION OF INVENTION

Figure 1:
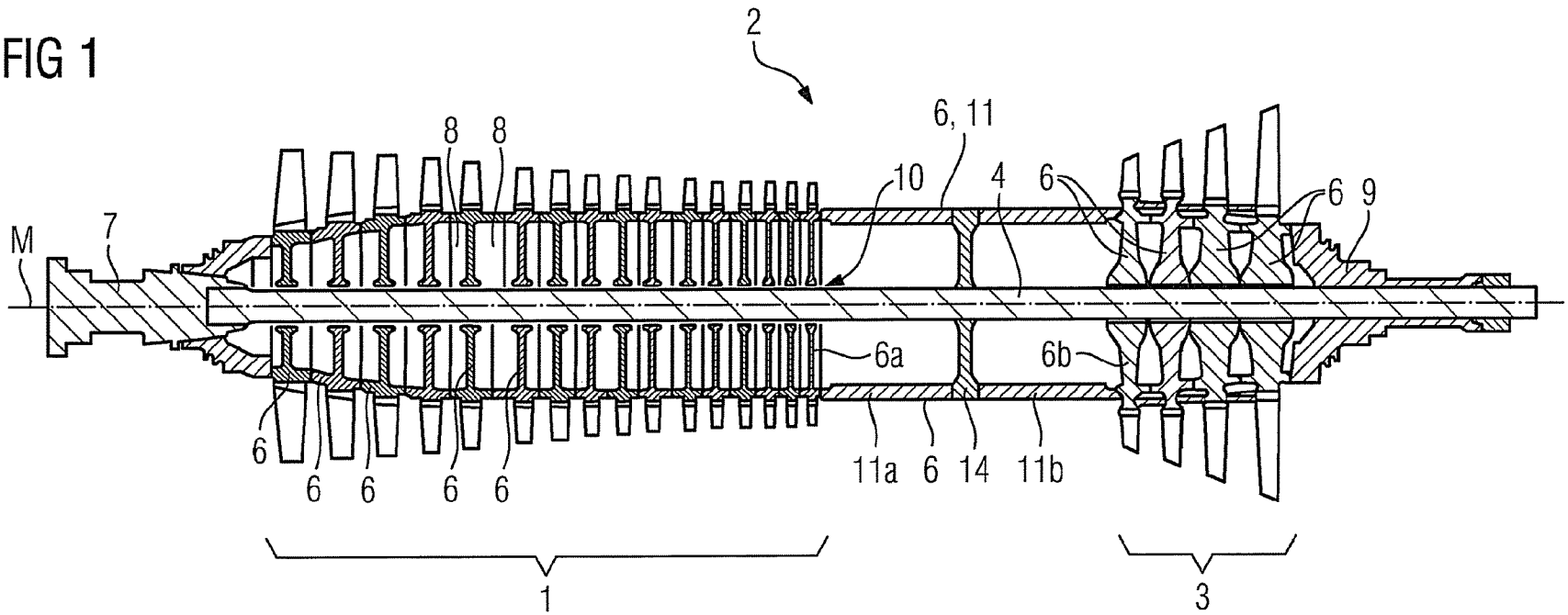
FIG. 1 shows a longitudinal section through a turbine rotor according to the invention.

A rotor 2 of a gas turbine, with a number of individual rotor components 6 which are held together by means of a tie-bolt 4 and assembled to faun a unit, is shown in FIG. 1 in a longitudinal section.

The rotor 2 has a compressor-side section 1 and a turbine-side section 3 with a number of rotor components 6 in each case. The respective rotor components 6, which are formed as rotor disks, are provided on the connection side, i.e. on the end face side, with recesses which extend symmetrically to the center axis M of the rotor 2 in the manner of a Hirth toothing, wherein the contours which result from it are formed corresponding to the contours of the respective adjacent rotor component 6, as a result of which a concentric alignment of the rotor components 6 to the center axis M is brought about.

Each of the rotor components 6 is provided with an axially extending bore 10 for the guiding through, with a clearance, of the tie-bolt 4. Moreover, a center hollow shaft 11 is arranged between the compressor-side rotor components 6 and the turbine-side rotor components 6. At the ends, the tie-bolt 4 is screwed to a rotor component 7, 9 in each case, as a result of which all rotor components 6 which are arranged in between are held together and clamped. The recesses 8 which are provided between the rotor components 6 serve for guiding a cooling medium for cooling the rotor components by cooling air being fed via a cooling passage which is formed between the tie-bolt 4 and the rotor component 6.

In order to be able to support the tie-bolt 4 in a suitable manner by means of rotating components, i.e. rotor components 6, which encompass it, a further rotor component 6 which is formed as a support wheel 14 is fitted between two rotor components 6, preferably between compressor-side section 1 of the rotor 2 and turbine-side section 3 of the rotor 2. For this purpose, the previously one-piece center hollow shaft 11 was divided into two tubular sections 11*a*, 11*b*, between which the support wheel 14 is preferably clamped. The support wheel 14 in this case represents a further rotor component. In this case the rotor components 6 and the support wheel 14 are clamped to each other by means of the tie-rod 4, wherein the support wheel 14, in contrast to the other rotor components 6, is additionally connected to the tie-rod 4 in a friction-locking and/or form-fitting manner.

In the detail, between that compressor-side rotor component 6*a* which is arranged nearest to the turbine-side section 3 and that turbine-side rotor component 6*b* which is arranged nearest to the compressor-side section 1, the center shaft 11, which comprises at least two tubular sections 11*a*, 11*b*, is arranged, between which tubular sections the support wheel 14 is clamped.

In addition to the support of the tie-bolt 4 in the region of the center hollow shaft 11, it is also possible to additionally secure the tie-bolt 4 against tie-bolt vibrations in the compressor-side section 1 or in the turbine-side section 3 by means of suitable damping elements such as damping cones. These then bridge the distance which customarily exists between tie-bolt 4 and tie-bolt opening 10.

Figure 2:
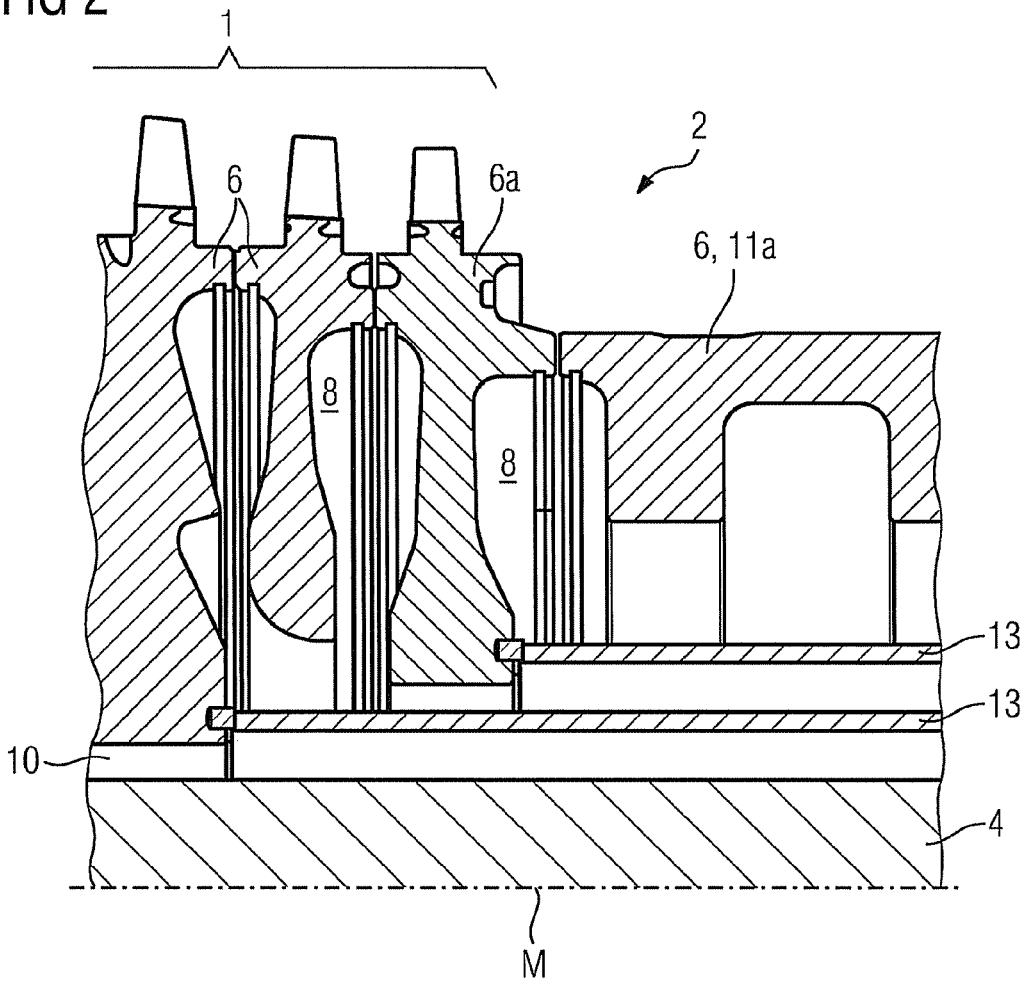
FIG. 2 shows a sectional partial view of a turbine rotor.

The illustration according to FIG. 2 shows a cross section through the compressor exit-side section of the rotor 2 in detail. Altogether three rotor components 6, which are fanned as rotor disks, of the compressor-side section 1 of the rotor 2 are shown in the illustration according to FIG. 2. In this case, that compressor-side rotor component which is the nearest facing the turbine-side section 3, which is not shown, is designated 6*a*. On the end face side, one of the two tubular sections 11 a of the center hollow shaft 11 abuts against the rotor component 6*a*. Radially further inwards, moreover, two cooling air separation pipes 13 are shown. Also, the cooling air separation pipes 13 are axially split into two sections for accommodating the support wheel 14 in such a way that their ends which point in the direction of the support wheel 14 can be guided in locating slots which are introduced in the support wheel 14 as provision for the said ends.

Figure 3:
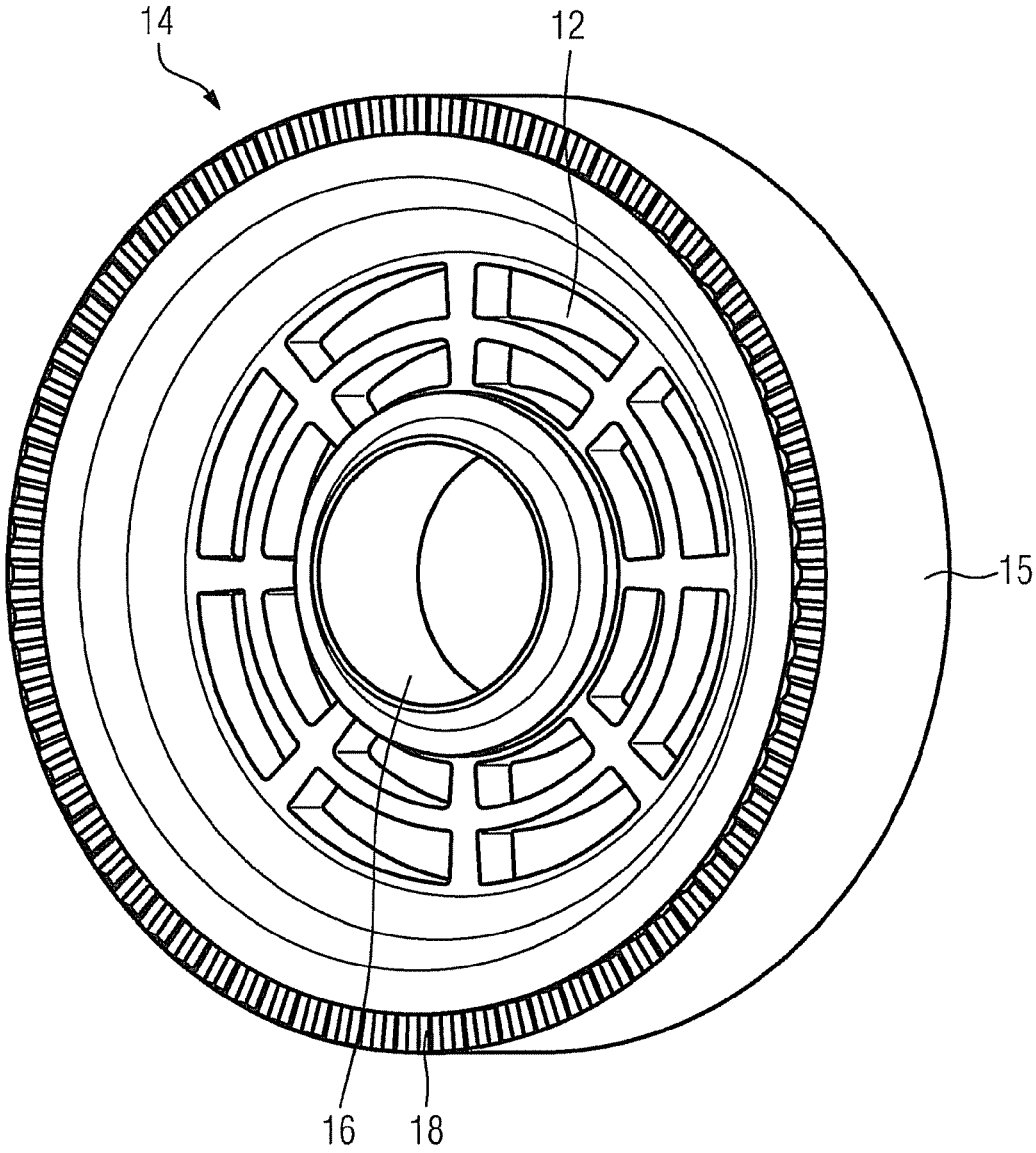
FIG. 3 shows a schematic view of a support wheel.

The illustration according to FIG. 3 shows a support wheel 14 which is provided with cooling openings 12, wherein the depth of the recesses 12 which serve as cooling openings 12 correspond to the material thickness of the support wheel 14 at this point. The recesses 12 in this case are introduced over the cross section of the support wheel 14 in a uniformly distributed manner so that a uniform cooling of the support wheel 14 can be carried out and therefore stresses and unequal deformations can be avoided. Moreover, the heat transfer to the cooling medium is carried out especially effectively since on account of the cooling surface which is enlarged as a result of the recesses 12 which are introduced into the wheel body 15 more heat can be carried away.

In order to be able to better absorb and transfer the high forces which act upon the rotor 2 during operation of the gas turbine, a Hirth toothing 18 is provided on the outer rim of the support wheel 14 on both sides on the end face. The center hollow shaft 11, which comprises two axial tubular sections, then bears on both sides of the support wheel 14 with a corresponding Hirth toothing. As a result of a form-fitting connection which is formed in such a way, the effect is moreover achieved of a self-centering action of the tie-bolt which is guided in the hub 16 being realized with a compact type of construction in addition to the transfer of high torque. Furthermore, a radial guiding for accommodating different heat and centrifugal force deformations and therefore a safe operation of the gas turbine is ensured.

Figure 4:
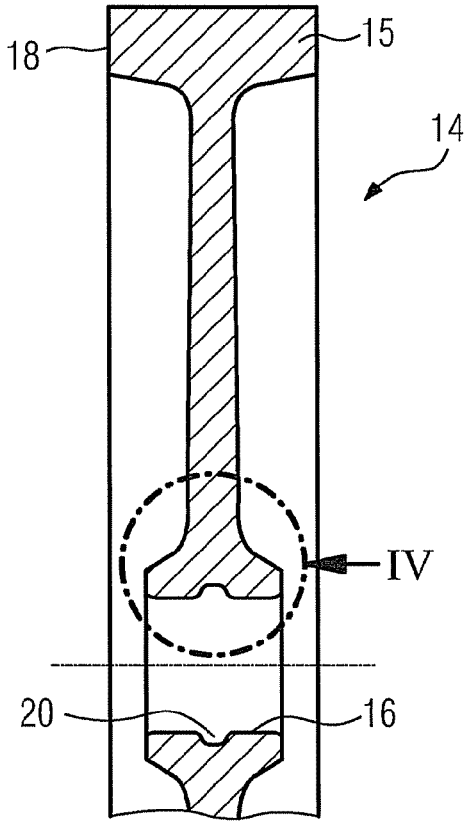
FIG. 4 shows a detail of the support wheel in longitudinal section.
Figure 5:
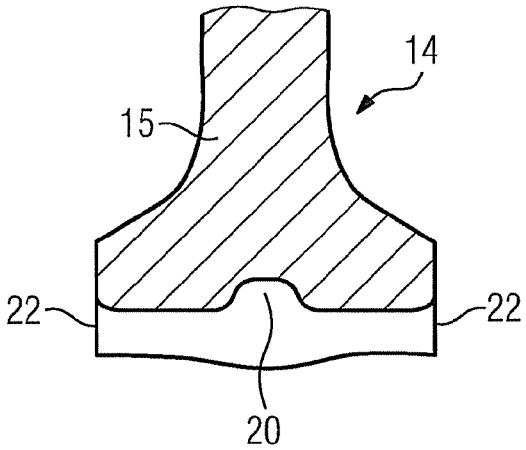
FIG. 5 shows a detailed view from FIG. 4.

As can be gathered from the view in FIG. 4 and FIG. 5, the hub 16 of the support wheel 14 on the tie-bolt side has a profile with a crowned shape. This can be realized in an especially simple way by means of an encompassing slot 20 which is introduced centrally into the hub 16, and also by means of rounding of the edges which extend circumferentially around the tie-bolt on the end face. This tie-bolt-side profile of the hub 16 enables compensation of the differential deformations of tie-bolt 4 and support wheel 14 which occur during operation of the gas turbine. Furthermore, as a result of this special shaping a redistribution of the stresses from the center of the hub 16 towards the end faces of the support wheel 14 is carried out. Increased stress which therefore occurs in the region of the end faces is comparatively non-critical, however, so that as a result of the flexible design on the tie-bolt side the operational safety of the gas turbine can be significantly increased.

The invention claimed is:

1. A rotor for a gas turbine, comprising:
a compressor-side section;
a turbine-side section;
a plurality of individual compressor-side rotor components
a plurality of individual turbine-side rotor components;
a tie-bolt;
wherein the plurality of individual compressor-side and turbine-side rotor components are pressed to each other using a tie-bolt and assembled to form a rotor unit,
wherein for each tie-bolt provided, each rotor component has a tie-bolt opening which extends centrally in an axial direction of the rotor,
wherein the tie-bolt extends centrally through the respective tie-bolt opening leaving a space between the tie-bolt and the respective rotor component,
wherein a support wheel is arranged as a rotor component between the turbine-side rotor section and the compressor-side rotor section and radially supports the tie-bolt,
wherein the support wheel has a central hub through which the tie-bolt extends,
wherein the support wheel is connect to two adjacently arranged rotor components using Hirth toothing, wherein the hub of the support wheel is provided with a crowned profile on a connection side.

2. The rotor as claimed in claim 1, wherein support wheel is connected to the tie-bolt in a friction-locking and/or a form-fitting manner.

3. The rotor as claimed in claim 1, wherein the support wheel is shrunk onto the tie-bolt.

4. The rotor as claimed in claim 1, wherein the support wheel is provided with a plurality of openings which guides a cooling medium through.

5. The rotor as claimed in claim 4, wherein the plurality of openings are uniformly spaced.

6. The rotor as claimed in claim 1,
wherein a center hollow shaft is arranged between the individual compressor-side rotor component arranged nearest to the turbine-side section and the individual turbine-side rotor component arranged nearest to the compressor-side section,
wherein the center hollow shaft includes at least two tubular sections and
wherein the support wheel is arranged between the at least two tubular sections.

7. The rotor as claimed in claim 1, wherein the plurality of turbine-side rotor components and/or the plurality of compressor-side rotor components are formed in each case by a rotor disk.

8. The rotor as claimed in claim 1,
wherein the tie-bolt is encompassed by a cooling separation pipe which guides cooling air through, and
wherein the cooling separation pipe is axially split into two sections in order to accommodate the support wheel, and
wherein an end of the cooling separation pipe pointing in a direction of the support wheel is guided into a locating slot in the support wheel.

9. A thermal turbomachine with a rotor, comprising:
a compressor-side section,
a turbine-side section,
a plurality of individual compressor-side rotor components,
a plurality of individual turbine-side rotor components,
a tie-bolt,
wherein the plurality of individual compressor-side and turbine-side rotor components are pressed to each other using a tie-bolt and assembled to form a rotor unit,
wherein for each tie-bolt provided, each rotor component has a tie-bolt opening which extends centrally in an axial direction of the rotor,
wherein the tie-bolt extends centrally through the respective tie-bolt opening leaving a space between the tie-bolt and the respective rotor component,
wherein a support wheel is arranged as a rotor component between the turbine-side rotor section and the compressor-side rotor section and radially supports the tie-bolt,
wherein the support wheel has a central hub through which the tie-bolt extends,
wherein the support wheel is connected to two adjacently arranged rotor components using Hirth toothing, wherein the hub of the support wheel is provided with a crowned profile on a connection side.

10. The thermal turbomachine as claimed in claim 9, wherein support wheel is connected to the tie-bolt in a friction-locking and/or a form-fitting manner.

11. The thermal turbomachine as claimed in claim 9, wherein the support wheel is shrunk onto the tie-bolt.

12. The thermal turbomachine as claimed in claim 9, wherein the support wheel is provided with a plurality of openings which guides a cooling medium through.

13. The thermal turbomachine as claimed in claim 12, wherein the plurality of openings are uniformly spaced.

14. The thermal turbomachine as claimed in claim 9,
wherein a center hollow shaft is arranged between the individual compressor-side rotor component arranged nearest to the turbine-side section and the individual turbine-side rotor component arranged nearest to the compressor-side section,
wherein the center hollow shaft includes at least two tubular sections and
wherein the support wheel is arranged between the at least two tubular sections.

15. The thermal turbomachine as claimed in claim 9, wherein the plurality of turbine-side rotor components and/or the plurality of compressor-side rotor components are formed in each case by a rotor disk.

16. The thermal turbomachine as claimed in claim 9,
wherein the tie-bolt is encompassed by a cooling separation pipe which guides cooling air through, and
wherein the cooling separation pipe is axially split into two sections in order to accommodate the support wheel, and
wherein an end of the cooling separation pipe pointing in a direction of the support wheel is guided into a locating slot in the support wheel.

* * * * *